US007490668B2

(12) United States Patent
Bour

(10) Patent No.: US 7,490,668 B2
(45) Date of Patent: Feb. 17, 2009

(54) METHOD FOR DESIGNING AND CONSTRUCTING A WELL WITH ENHANCED DURABILITY

(75) Inventor: Daniel L. Bour, Bakersfield, CA (US)

(73) Assignee: Halliburton Energy Services, Inc., Duncan, OK (US)

( * ) Notice: Subject to any disclaimer, the term of this patent is extended or adjusted under 35 U.S.C. 154(b) by 351 days.

(21) Appl. No.: 10/913,600

(22) Filed: Aug. 5, 2004

(65) Prior Publication Data

US 2006/0027366 A1 Feb. 9, 2006

(51) Int. Cl.
*E21B 33/14* (2006.01)

(52) U.S. Cl. ..... 166/285; 166/291; 166/153

(58) Field of Classification Search ..... 166/285, 166/291, 153
See application file for complete search history.

(56) References Cited

U.S. PATENT DOCUMENTS

| | | | | | |
|---|---|---|---|---|---|
| 3,299,953 | A | * | 1/1967 | Bernard | 166/285 |
| 3,412,795 | A | * | 11/1968 | Lyman | 166/285 |
| 4,234,344 | A | | 11/1980 | Tinsley et al. | 106/88 |
| 4,856,592 | A | * | 8/1989 | Van Bilderbeek et al. | 166/285 |
| 4,997,487 | A | | 3/1991 | Vinson et al. | 106/804 |
| 5,123,487 | A | | 6/1992 | Harris et al. | 166/277 |
| 5,125,455 | A | | 6/1992 | Harris et al. | 166/292 |
| 5,127,473 | A | | 7/1992 | Harris et al. | 166/277 |
| 5,133,409 | A | | 7/1992 | Bour et al. | 166/293 |
| 5,147,565 | A | | 9/1992 | Bour et al. | 252/8.551 |
| 5,159,980 | A | | 11/1992 | Onan et al. | 166/294 |
| 5,265,247 | A | | 11/1993 | Wienck et al. | 395/600 |
| 5,293,938 | A | | 3/1994 | Onan et al. | 166/293 |
| 5,325,921 | A | * | 7/1994 | Johnson et al. | 166/280.1 |
| 5,361,837 | A | * | 11/1994 | Winbow | 166/249 |
| 5,455,780 | A | | 10/1995 | Nguyen et al. | 364/578 |
| 5,588,488 | A | | 12/1996 | Vijn et al. | 166/293 |
| 5,588,489 | A | | 12/1996 | Chatterji et al. | 166/293 |
| 5,762,139 | A | * | 6/1998 | Sullaway et al. | 166/291 |
| 5,901,964 | A | * | 5/1999 | Williams et al. | 277/326 |
| RE37,867 | E | | 10/2002 | Gondouin | 166/380 |
| 6,488,089 | B1 | | 12/2002 | Bour et al. | 166/292 |
| 6,513,592 | B2 | * | 2/2003 | Espin et al. | 166/295 |
| 6,697,738 | B2 | | 2/2004 | Ravi et al. | 702/6 |
| 6,702,044 | B2 | * | 3/2004 | Reddy et al. | 175/64 |
| 6,920,929 | B2 | * | 7/2005 | Bour | 166/292 |
| 2004/0083058 | A1 | | 4/2004 | Ravi et al. | 702/6 |

(Continued)

FOREIGN PATENT DOCUMENTS

EP 0 903 462 A1 3/1999

OTHER PUBLICATIONS

SPE 38598 paper entitled "Cement Design Based On Cement Mechanical Response" by M.J. Thiercelin et al., dated 1997.

(Continued)

*Primary Examiner*—Shane Bomar
(74) *Attorney, Agent, or Firm*—Craig W. Roddy; Haynes and Boone LLP

(57) ABSTRACT

Methods for performing cementing operations in a wellbore, designing wells and constructing wells are illustrated. The methods include applying pressure to the interior of casing in the wellbore during curing of a cement composition in the annulus. Wells constructed with such an applied pressure on casing have cement sheaths that will subsequently withstand stress.

45 Claims, 2 Drawing Sheets

U.S. PATENT DOCUMENTS

2004/0211570 A1* 10/2004 Chen et al. ..... 166/382

OTHER PUBLICATIONS

SPE 46215 paper entitled "Foam Cementing Cyclic-Steam, Producing Wells: Cymric Field Case Study" by Larry S. Miller et al., dated 1998.

SPE 56536 paper entitled "Design Approach to Sealant Selection for the Life of the Well" by Martin Bosma et al., dated 1999.

IADC/Spe 62745 paper entitled "Cements for Long Term Isolation—Design Optimization by Computer Modelling and Prediction" by Gino Di Lullo et al., dated 2000.

Paper entitled "Life Cycle Modeling of Wellbore Cement Systems Used For Enhanced Geothermal System Development" by Jess McCullogh et al., Geothermal Resource Council Meeting, Morelia, Mexico, Oct. 12-15, 2003.

David Stein, et al.: Well Completions—Cement Pulsation Reduces Remedial Cementing Costs; GasTIPS, Winter 2003; pp. 22-24 (month unknown).

CTES; Cement Pulsation—Improve Zonal Isolation with Surface Pressure Pulses (date unknown).

Dwight K. Smith; Cementing; Factors That Influence Cement Slurry Design; pp. 47-49, 1990 (month unknown).

* cited by examiner

METHOD FOR DESIGNING AND CONSTRUCTING A WELL WITH ENHANCED DURABILITY

BACKGROUND

The present embodiment relates generally to methods for cementing in a wellbore, designing a well, constructing a well, and wells constructed according to such methods.

In the drilling and completion of an oil or gas well, a wellbore is drilled, and one or more pipe strings or casings are introduced into the wellbore. A cement composition is introduced into the wellbore and forms a cement sheath that cements the casing(s) into place.

It is understood that one of the objectives of the cement sheath is to achieve and maintain zonal isolation. Throughout the life of a well, however, the well encounters stresses that can compromise the integrity of the cement sheath, and therefore compromise zonal isolation. Stress can be caused by pressure or temperature changes in the wellbore, which are often the result of activities undertaken in the well bore, such as pressure testing, well completion operations, hydraulic fracturing, steam injection and hydrocarbon production.

For example, in a cyclic steam well, the cement sheath in the wellbore is stressed by the temperature rise and injection pressure during a steam injection cycle in the well. Such temperature and pressure rise causes expansion of the casing held in place by the cement sheath, which expansion puts tensile stress and compressive stress loadings on the cement sheath and can result in compromised zonal isolation or complete failure of the cement sheath. In addition, wellbores in formations that are not able to provide much confining stress to hold the cement sheath in place during these injection cycles are much more susceptible to failure of the cement sheath.

Thus, stresses that occur within a wellbore can cause radial cracks in the cement sheath, crushing of the cement composition or shear failure, de-bonding between the cement composition and the wellbore, or de-bonding between the cement composition and one or more casing(s). Each of the foregoing cement failures compromises zonal isolation.

DESCRIPTION

Methods for performing cementing operations in a wellbore, and for designing and constructing wells that improve the ability of cement sheaths in the well to withstand stress are exemplified herein. The ability of a cement sheath to withstand stress is identified by whether or not it has any "remaining capacity" after being stressed due to a well event. In general, the greater the remaining capacity of a cement sheath, the better its ability to withstand a given stress and therefore the less likely it is to crack, de-bond, or otherwise deteriorate. Such cracking, de-bonding, deterioration and compromise of zonal isolation are types of "cement failure" or "failure of the cement".

An exemplary method for cementing in a wellbore and for constructing a well according to the present disclosure includes applying pressure to the interior of casing, such as production casing, placed in a wellbore while a cement composition is curing in an annulus formed at least in part by the casing. The amount of pressure applied can be in the range of from about 50 psi to about 20,000 psi. In certain examples, the amount of pressure applied is in the range of from about 100 to about 8000 psi, while in other examples, the amount of pressure applied is in the range of from about 500 to about 7000 psi.

Pressure can be applied to the interior of the casing by, for example, a gas pressurization method or a fluid pressurization method, each of which is described further below. With either the gas pressurization or fluid pressurization method, construction of the well is substantially conventional, except for the application of pressure to the casing and any equipment adjustments associated therewith.

Figure 1:
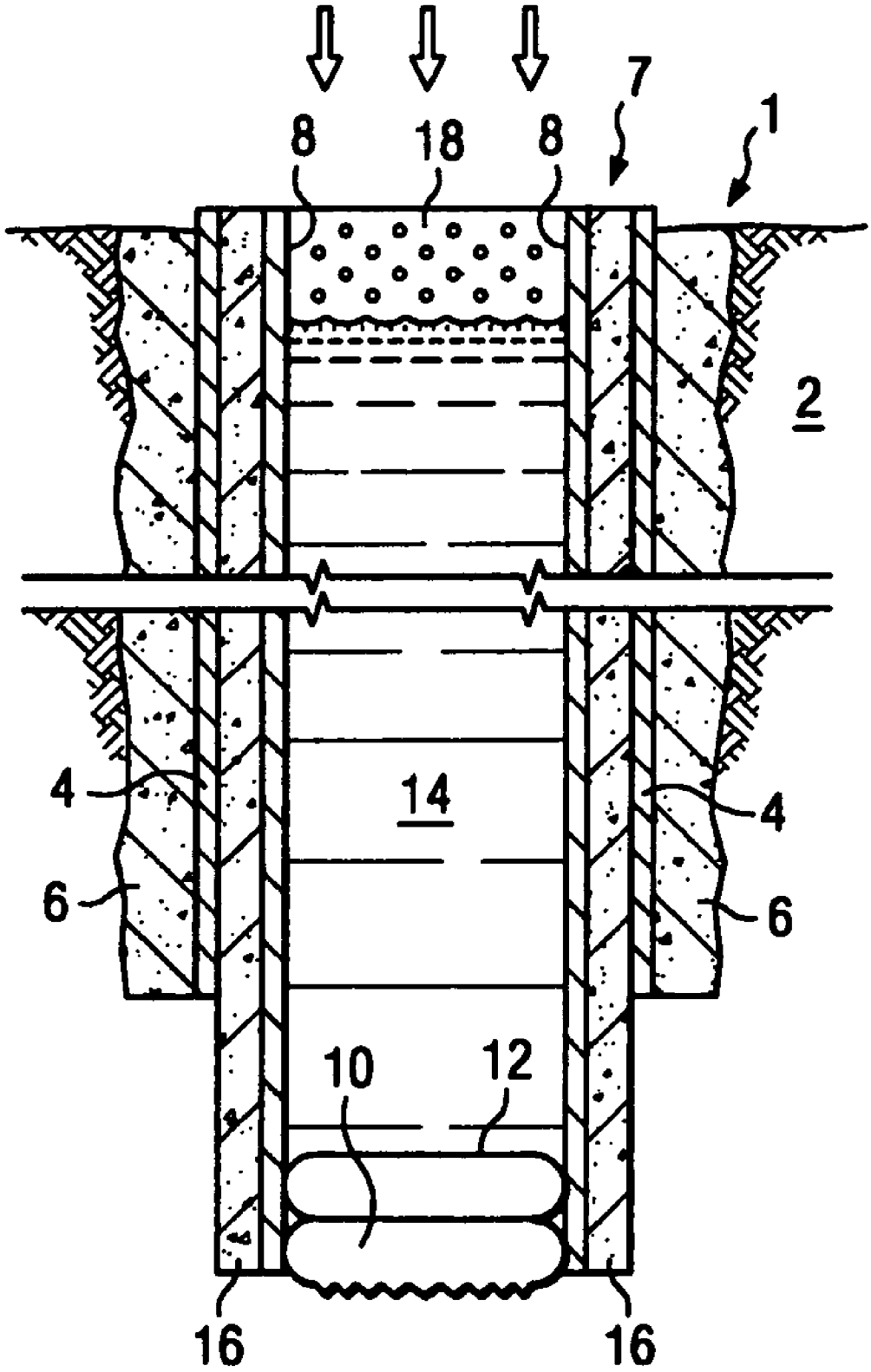
FIG. 1 illustrates a well constructed according to a method that includes applying pressure on casing in the well.

Referring now to FIG. 1, a well constructed according to one example of the methods disclosed herein is illustrated. A wellbore 1 is drilled through a formation 2 and a surface casing 4 is run into the wellbore. The surface casing 4 is cemented in the wellbore by pumping a cement composition 6 through the surface casing and into the annulus between the surface casing and the formation according to methods known to those of ordinary skill in the art. With the surface casing 4 in place, the wellbore is extended by drilling wellbore extension 7. Additional casing can be run into wellbore extension 7. In the well illustrated in FIG. 1, only production casing 8 is illustrated, although additional casing, which may be referred to as intermediate casing, can also be run through the surface casing and into wellbore extension 7. The production casing 8 is run through the surface casing (any intermediate casing) and into the wellbore. Regardless of whether intermediate casings are present, the production casing is referred to herein as being run through the surface casing, as it is understood by one of ordinary skill in the art that production casing is positioned through the surface casing, even if it is surrounded by an intermediate casing.

To cement the production casing in the wellbore, a bottom plug 10 is typically released into the production casing 8 to precede a cement composition that is pumped into the production casing 8. In the exemplary well illustrated in FIG. 1, it is the production casing that receives the applied pressure. Thus, while the bottom plug can be any equipment known to those of ordinary skill in the art, including but not limited to a casing shoe, casing collar, latch-down plug and guide shoe/float collar, the equipment selected for the bottom plug needs to withstand the pressure that will be subsequently applied to the production casing.

As the last of the cement composition enters the production casing, a top plug 12 is released, and follows the cement composition down the casing. In the present methods, the top plug can be any equipment known to those of ordinary skill in the art for such purpose, as long as the equipment selected for the top plug can withstand the pressure that will be subsequently applied to the production casing.

The top plug 12 is followed by a displacement fluid 14, which can be, for example, drilling fluid, water, brine, or other fluid. The displacement fluid 14 is pumped into the production casing 8 by conventional pumping equipment (not illustrated) known to those of ordinary skill in the art. As the top plug 12 makes its way down the production casing 8, the cement composition is displaced from the production casing 8 and into an annulus (also referred to herein as the "production casing annulus"), which is formed in part by the production casing 8 and the surface casing 4, and in part by the production casing 8 and the formation 2. When the top plug 12 contacts the bottom plug 10, the cement composition 16 is substantially within the production casing annulus where it will cure. Other devices not illustrated may be included in the well, including devices known as packers, which are commonly used in many oilfield applications for the purpose of sealing against the flow of fluid to isolate one or more portions of a well bore for the purposes of testing, treating or producing the well.

Pressure is applied to the interior of the production casing while the cement composition cures in the production casing annulus. According to the fluid pressurization method, the pressure is applied to the production casing 8 by continuing to pump the displacement fluid 14 into the production casing until the pressure applied by the displacement fluid has reached the desired amount. Conventional pumping equipment has a pressure gauge that reports the pressure inside the casing. Thus, pumping of the displacement fluid 14 can continue until the pressure gauge reports that the pressure applied by the displacement fluid has reached the desired amount.

According to the gas pressurization method, pressure is applied to the interior of casing in a wellbore by introducing a gas, for example, nitrogen, into the casing, either before, during, or after the introduction of the displacement fluid into the casing. The gas is pumped into the casing by conventional pumping equipment or simply injected from a pressurized vessel having a pressure gauge to report the pressure inside the casing. Such equipment is known to those of ordinary skill in the art.

According to an example where the gas is introduced before the displacement fluid, the gas would be introduced after the top plug, followed by introduction of the displacement fluid after the gas. According to an example where the gas is introduced during the introduction of the displacement fluid, the gas and displacement fluid are introduced into the casing simultaneously. According to an example where the gas is introduced after the displacement fluid, the displacement fluid is introduced after the top plug, followed by introduction of the gas. With gas introduction before, during, or after displacement fluid introduction, when the top plug contacts the bottom plug, the casing is pressurized by pumping more gas and/or displacement fluid into the casing. The pumping of either the displacement fluid or the gas continues until the pressure in the casing reaches a desired amount.

Moreover, regardless of whether the gas is introduced before, during, or after the displacement fluid, the gas 18 will generally rise to the top of the column of displacement fluid, as illustrated in FIG. 1. In certain examples, gas pressurization will minimize pressure increases caused by thermal expansion of fluid inside the casing, and prevent loss of applied pressure on the production casing (which would occur if for some reason, fluid inside the casing cooled off and shrunk). It is expected that introducing of the gas and/or fluid continues, the gas and/or fluid entering the casing will compress and/or cause radial expansion of the casing.

According to the present disclosure, pressure is applied to the interior of the casing while the cement in the casing annulus is curing. According to certain examples, the pressure is applied until the cement composition in the casing annulus has developed compressive strength. In other examples, the pressure is applied until the cement composition in the casing annulus has set.

When the cement composition in the casing annulus has set, further well construction, well events such as injection or production, or other well operations known to those of ordinary skill in the art can be performed. Wells constructed according to methods that include an applied pressure on casing in the wellbore during cement curing have cement sheaths that can be less likely to fail and better able to withstand the stress caused by such subsequent well operations. Wells constructed according to methods that include applying pressure on casing in the wellbore during curing are described herein as having a "pre-stressed" casing, because the application of pressure to the casing exerts an initial stress on the casing, which reduces the effective stress on the cement sheath caused by subsequent well events.

Methods for designing a well are also disclosed herein. According to such methods, a well is simulated and well events and an applied pressure on the interior of casing in the well are simulated in order to analyze the ability of a cement sheath in the well to withstand stress caused by such well events. With such simulations, well designs and construction programs can be prepared for the subsequent construction of real-time wells with cement sheaths having optimum capacity to withstand stress. According to the methods disclosed herein, well designs are prepared using well simulations run with a suitable finite element analysis software program, such as the WELLLIFE™ software program, which is commercially available from Halliburton Company, Houston, Tex.

Data regarding a cement composition to be used in the well, characteristics of the wellbore, and well events that will occur in the well is provided to the finite element analysis software program to simulate the well and well events. An applied pressure factor is also provided to the program to simulate an applied pressure on the interior of casing in the well.

Data regarding a selected cement composition is available from its commercial source, and includes properties such as Young's modulus, tensile strength and Poisson's ratio. Data regarding the well includes routinely measurable or calculable parameters in a well, such as characteristics of the formation in which the well is drilled (e.g., Poisson's ratio, Young's modulus), vertical depth of the well, hole size, casing outer diameter, casing inner diameter, density of drilling fluid, desired density of cement slurry for pumping and density of completion fluid. Data regarding the selected well event(s) can be representative of any well event, including but not limited to, pressure testing, well completion, hydraulic fracturing, hydrocarbon production, fluid injection, perforation and steam injection. The data regarding such well event would depend on the selected well event, and could include data such as pressure changes, temperature changes, and densities of fluids.

The applied pressure factor is calculated by determining a multiplication product, which is calculated by multiplying a pressure gradient associated with a selected well fluid having a known density by a selected depth at which to evaluate the well (the "evaluation depth"). The multiplication product of the pressure gradient and the evaluation depth is added to a selected amount of pressure to be applied on casing in the well, and this sum is divided by the evaluation depth. The resulting quotient is the applied pressure factor and is input into the software program to simulate an applied pressure on the interior of the casing during curing.

The selected well fluid can have any density, as long as a pressure gradient can be determined for it. Typically, the selected well fluid will have a density in the range of those densities associated with conventional well fluids such as drilling fluids and displacement fluids. The depth at which to evaluate a well (the "evaluation depth") can be selected for any number of reasons. For example, in any given well, there may be one or more target depths at which the capacity of the cement sheath is a primary concern, and such target depths would be selected as evaluation depths. For example, in certain wells, it may be most desirable to prevent a cement failure at a target depth at which a well event, such as steam injection or production, occurs. In such a well, cement failure at other depths, especially depths shallower then the target depth may be a secondary concern. Moreover, in any given well, there may be one type of cement failure that is a primary concern. For example, in certain wells, it may be most desirable to prevent radial cracks in the cement sheath. In still other examples, it may desirable to prevent radial cracks in the cement sheath primarily, and secondarily to prevent shear deterioration in the cement sheath, de-bonding at the formation and de-bonding at the casing.

Methods for designing a well as provided herein are particularly helpful when deciding whether an actual well can be expected to have a long life or experience cement failure early in its life, and determining whether and how an actual well can be constructed cost-effectively. By simulating a well and analyzing it at a target depth, the performance of an actual well at such a target depth can be reviewed prior to incurring the cost of constructing the well.

According to the present methods for cementing in a wellbore, designing a well and constructing a well, the capacity of the cement sheath in the well is improved by applying pressure to the interior of casing in the well while the cement composition cures. The methods disclosed herein are adaptable to a wide range of wells, including those wells where preventing a certain type of cement failure at a particular depth or during a particular well event is a concern.

The following examples are illustrative of the foregoing methods. Because factors such as total depth of a well, diameter of a well, and characteristics of the formation will vary from well to well, the values provided in the examples herein are merely illustrative. For example, the well diameter could be any, and a range of from about 1 inch to about 14 inches is merely exemplary. Further, properties of the formation simulated in the following examples included a Poisson's ratio of 0.25 and a Young's modulus of 35,000 psi, however these are merely exemplary values. As yet another example, hole sizes simulated in the following examples were between 7 inches to about 11 inches, however in other simulations or in constructed wells, the hole size could be in a range of from about 3 inches to about 30 inches, or other ranges. Other properties of the well, the cement composition and the well events can also vary from those exemplified herein.

Thus, the methods disclosed herein have a broad range of applicability, including but not limited to, wells of a deeper or shallower total depth, formations that are harder or softer, production and/or surface casing of a lighter or heavier weight, and production and surface casing set depths that are deeper or shallower than those illustrated herein.

In each of the following examples, wells, well events and applied pressures were simulated using the WELLLIFE™ software program, available from Halliburton Company, Houston, Tex. The WELLLIFE™ software program is built on the DIANA™ Finite Element Analysis program, available from TNO Building and Construction Research, Delft, the Netherlands. In each example, the WELLLIFE™ program was operated per operating procedures provided therefore. Such operating procedures call for data that is not reported in the tables below, for example, minimum and maximum formation stress ratios and formation pore pressure, which is not necessary to illustrate and understand the presently disclosed methods. The data reported in the tables below is sufficient to illustrate and convey the present methods to the understanding of one of ordinary skill in the art.

In each of the following examples, the WELLLIFE™ software program, was used to predict the capacity of cement sheaths during various stress regimes that the cement sheaths would be subjected to during the life of the well. In particular, the WELLLIFE™ software program was used to assess whether an applied pressure on the production casing would prevent or lessen de-bonding between the cement sheath and the formation, de-bonding between the cement sheath and the casing, shear deterioration in the cement sheath, and/or radial cracking in the cement sheath.

EXAMPLE 1

The data regarding production casing, cementing composition and well events described below in Table 1A apply to all wells simulated in this Example 1. The data regarding surface casing was provided to the WELLLIFE™ program for those simulations in which the effect of the well event on the cement sheath would be analyzed at depths equal to or less than the set depth of the surface casing (which analyses are reported in Tables 1B-1E). Providing the surface casing weight was not necessary to simulate the wells of this Example 1, however, the surface casing simulated in this Example 1 would have an actual weight of 36 lb/ft.

The data regarding hole size was provided to the WELLLIFE™ program for those simulations in which the effect of the well event on the cement sheath would be analyzed at depths greater than the set depth of the surface casing (which analyses are reported in Tables 1F-1H). Since hole size rather than surface casing data was provided, the simulations analyzed for Tables 1F-1H can be referred to as "open hole" simulations.

TABLE 1A

| Production Casing | | Surface Casing | |
|---|---|---|---|
| outer diameter (inches) | 7 | outer diameter (inches) | 9⅝ |
| inner diameter (inches) | 6.248 | inner diameter (inches) | 8.921 |
| weight (lbs/ft.) | 26 | weight (lbs/ft.) | not input to the program |
| set depth (feet) | 1600 | set depth (feet) | 900 |
| Hole Size (inches) | 8.75 | Total Well Depth (ft.) | 1600 |
| **Cementing Composition** | | **Formation** | |
| Young's Modulus (psi) | $0.7 \times 10^6$ | Poisson's Ratio | 0.25 |
| Tensile Strength (psi) | 350 | Young's modulus (psi) | 35,000 |
| Poisson's Ratio | 0.23 | | |
| Density (lb/gal) | 12 | | |
| Other | non-shrinking foamed cement | | |

TABLE 1A-continued

Figure 2:
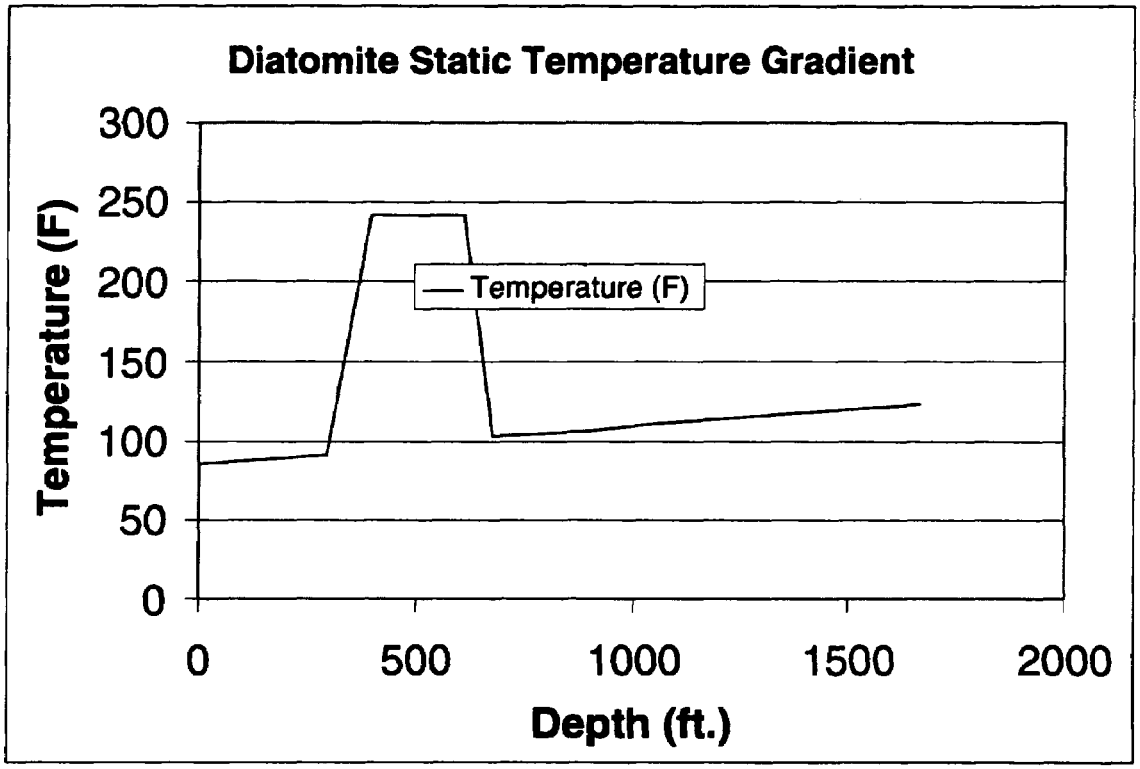
FIG. 2 illustrates a geostatic temperature gradient used for simulating well events within a well.

| Well Events | |
|---|---|
| curing of cement | simulated with a pressure gradient equal to the hydrostatic pressure exerted by a 9.3 lb/gal fluid inside the production casing, the pressure gradient of the cement composition (12 lb/gal) outside the production casing and the surface casing, and a temperature gradient as illustrated in FIG. 2 |
| pressure testing | simulated to occur after cement set, with an applied surface pressure of 2000 psi, plus the pressure gradient of the 9.3 lb/gal fluid inside the production casing |
| well completion | simulated to occur over 14 days, with a pressure gradient equal to the hydrostatic pressure exerted by the 9.3 lb/gal fluid inside the production casing, a temperature gradient inside the wellbore from 85 to 150° F., and formation temperatures close to the static temperature gradient illustrated in FIG. 2 |
| steam injection | simulated to occur at 580° F. and 1300 psi injection pressure; simulated that injection would expose the cement sheath holding the 7 inch production casing in place to +/−500° F. |

Data reflecting a pressure to be applied to the interior of the production casing while the cement cured was provided to the WELLLIFE™ software program to analyze the effect such applied pressure would have on the capacity of the cement sheaths, at various depths in the well, to withstand the stress of the simulated well events. To simulate the applied pressure, the gradient of a 9.3 lb/gal fluid was multiplied by the depth to be evaluated, and then added to the amount of pressure to be applied. The sum was then divided by the depth to be evaluated, and the result was input into the WELLLIFE™ program.

For example, in Example 1, a pressure of 4400 psi was applied to the production casing of certain wells. Thus, to evaluate the capacity of the cement sheath at an evaluation depth of 900 ft., for example, the pressure gradient of the 9.3 lb/gal fluid used in simulation of well events was multiplied by 900 ft. Those of ordinary skill in the art can determine that the pressure gradient of a 9.3 lb/gal fluid is 0.48 psi/ft. Thus, the multiplication product was the product of 0.48 psi/ft and 900 ft. This multiplication product was then added to 4400 psi. The sum was then divided by 900 ft., and the result was input into the WELLLIFE™ program as an applied pressure factor to simulate a real-time application of 4400 psi on the production casing.

The remaining capacity of the cement sheath at evaluation depths from 250 ft. to 1500 ft., with applied pressures from 2300-4800 psi, are reported in Tables 1B-1H below.

TABLE 1B

| | Test Depth: 250 ft. Remaining Capacity (%) for Type of Stress and Applied Pressure (psi) on Production Casing | | | | | | | |
|---|---|---|---|---|---|---|---|---|
| | De-bonding at Formation | | De-bonding at Casing | | Shear deterioration in Cement | | Radial Cracks in Cement | |
| | Casing Pressure during Cement Curing | | | | | | | |
| Well Event | 0 psi | 4400 psi | 0 psi | 4400 psi | 0 psi | 4400 psi | 0 psi | 4400 psi |
| Curing | 100 | 100 | 100 | 100 | 100 | 100 | 100 | 100 |
| Pressure test | 100 | 30 | 100 | 40 | 75 | 70 | 50 | 55 |
| Completion | 100 | 0 | 100 | 10 | 100 | 45 | 100 | 30 |
| Injection | 100 | 0 | 100 | 25 | 10 | 28 | 0 | 0 |

TABLE 1C

| | Test Depth: 500 ft. Remaining Capacity (%) for Type of Stress and Applied Pressure (psi) on Production Casing | | | | | | | |
|---|---|---|---|---|---|---|---|---|
| | De-bonding at Formation | | De-bonding at Casing | | Shear deterioration in Cement | | Radial Cracks in Cement | |
| | Casing Pressure during Cement Curing | | | | | | | |
| Well Event | 0 psi | 4400 psi | 0 psi | 4400 psi | 0 psi | 4400 psi | 0 psi | 4400 psi |
| Curing | 100 | 100 | 100 | 100 | 100 | 100 | 100 | 100 |
| Pressure test | 100 | 10 | 100 | 57 | 75 | 70 | 60 | 65 |
| Completion | 100 | 0 | 100 | 45 | 98 | 51 | 97 | 55 |
| Injection | 100 | 0 | 100 | 53 | 10 | 23 | 0 | 0 |

TABLE 1D

| | Test Depth: 750 ft. Remaining Capacity (%) for Type of Stress and Applied Pressure (psi) on Production Casing | | | | | | | |
|---|---|---|---|---|---|---|---|---|
| | De-bonding at Formation | | De-bonding at Casing | | Shear deterioration in Cement | | Radial Cracks in Cement | |
| | Casing Pressure during Cement Curing | | | | | | | |
| Well Event | 0 psi | 4400 psi | 0 psi | 4400 psi | 0 psi | 4400 psi | 0 psi | 4400 psi |
| Curing | 100 | 100 | 100 | 100 | 100 | 100 | 100 | 100 |
| Pressure test | 100 | 72 | 100 | 68 | 75 | 70 | 68 | 72 |
| Completion | 98 | 48 | 98 | 38 | 98 | 45 | 97 | 46 |
| Injection | 100 | 60 | 100 | 52 | 4 | 28 | 0 | 7 |

TABLE 1E

| | Test Depth: 900 ft. Remaining Capacity (%) for Type of Stress and Applied Pressure (psi) on Production Casing | | | | | | | | | | | | | | | |
|---|---|---|---|---|---|---|---|---|---|---|---|---|---|---|---|---|
| | De-bonding at Formation | | | | De-bonding at Casing | | | | Shear deterioration in Cement | | | | Radial Cracks in Cement | | | |
| | Casing Pressure during Cement Curing | | | | | | | | | | | | | | | |
| Well Event | 0 psi | 2300 psi | 4400 psi | 4800 psi | 0 psi | 2300 psi | 4400 psi | 4800 psi | 0 psi | 2300 psi | 4400 psi | 4800 psi | 0 psi | 2300 psi | 4400 psi | 4800 psi |
| Curing | 100 | 100 | 100 | 100 | 100 | 100 | 100 | 100 | 100 | 100 | 100 | 100 | 100 | 100 | 100 | 100 |
| Pressure test | 100 | 95 | 45 | 43 | 100 | 96 | 70 | 70 | 75 | 97 | 70 | 72 | 70 | 98 | 75 | 75 |
| Completion | 100 | 50 | 3 | 0 | 100 | 75 | 48 | 48 | 99 | 75 | 50 | 48 | 98 | 78 | 55 | 55 |
| Injection | 100 | 68 | 20 | 18 | 100 | 85 | 55 | 57 | 1 | 11 | 32 | 31 | 0 | 0 | 20 | 19 |

TABLE 1F

| | Test Depth: 1000 ft. Remaining Capacity (%) for Type of Stress and Applied Pressure (psi) on Production Casing | | | | | | | | | | | | | | | |
|---|---|---|---|---|---|---|---|---|---|---|---|---|---|---|---|---|
| | De-bonding at Formation | | | | De-bonding at Casing | | | | Shear deterioration in Cement | | | | Radial Cracks in Cement | | | |
| | Casing Pressure during Cement Curing | | | | | | | | | | | | | | | |
| Well Event | 0 psi | 2300 psi | 4400 psi | 4800 psi | 0 psi | 2300 psi | 4400 psi | 4800 psi | 0 psi | 2300 psi | 4400 psi | 4800 psi | 0 psi | 2300 psi | 4400 psi | 4800 psi |
| Curing | 100 | 100 | 100 | 100 | 100 | 100 | 100 | 100 | 100 | 100 | 100 | 100 | 100 | 100 | 100 | 100 |
| Pressure test | 100 | 99 | 95 | 95 | 100 | 97 | 89 | 86 | 78 | 95 | 75 | 71 | 67 | 97 | 90 | 88 |
| Completion | 100 | 96 | 91 | 91 | 100 | 88 | 80 | 77 | 99 | 75 | 57 | 53 | 98 | 91 | 83 | 82 |
| Injection | 100 | 97 | 92 | 92 | 100 | 93 | 83 | 81 | 10 | 29 | 35 | 35 | 0 | 0 | 0 | 0 |

TABLE 1G

| | Test Depth: 1250 ft. Remaining Capacity (%) for Type of Stress and Applied Pressure (psi) on Production Casing | | | | | | | | | | | |
|---|---|---|---|---|---|---|---|---|---|---|---|---|
| | De-bonding at Formation | | | De-bonding at Casing | | | Shear deterioration in Cement | | | Radial Cracks in Cement | | |
| | Casing Pressure during Cement Curing | | | | | | | | | | | |
| Well Event | 0 psi | 4400 psi | 4800 psi | 0 psi | 4400 psi | 4800 psi | 0 psi | 4400 psi | 4800 psi | 0 psi | 4400 psi | 4800 psi |
| Curing | 100 | 100 | 100 | 100 | 100 | 100 | 100 | 100 | 100 | 100 | 100 | 100 |
| Pressure test | 100 | 95 | 95 | 100 | 90 | 84 | 80 | 75 | 60 | 71 | 92 | 86 |
| Completion | 100 | 91 | 91 | 100 | 83 | 76 | 99 | 60 | 44 | 98 | 85 | 79 |
| Injection | 100 | 92 | 92 | 100 | 85 | 79 | 19 | 43 | 48 | 0 | 20 | 40 |

TABLE 1H

| | Test Depth: 1500 ft. Remaining Capacity (%) for Type of Stress and Applied Pressure (psi) on Production Casing | | | | | | | |
|---|---|---|---|---|---|---|---|---|
| | De-bonding at Formation | | De-bonding at Casing | | Shear deterioration in Cement | | Radial Cracks in Cement | |
| | Casing Pressure during Cement Curing | | | | | | | |
| Well Event | 0 psi | 4400 psi | 0 psi | 4400 psi | 0 psi | 4400 psi | 0 psi | 4400 psi |
| Curing | 100 | 100 | 100 | 100 | 100 | 100 | 100 | 100 |
| Pressure test | 100 | 95 | 100 | 90 | 80 | 77 | 75 | 92 |
| Completion | 100 | 91 | 100 | 84 | 99 | 60 | 98 | 86 |
| Injection | 100 | 92 | 100 | 86 | 0 | 15 | 0 | 0 |

The data reported in Tables 1B-1H indicate that when designing and constructing a well, an applied pressure on the interior of the production casing should be considered as a factor that causes beneficial results on the capacity of the cement sheath at a range of depths during a range of well events. For example, at each depth evaluated and reported in Tables 1B-1H, the remaining capacity of the cement sheath under radial stress during pressure testing is greater where pressure was applied to the production casing, as compared to the cement sheath where pressure was not applied to the production casing. Thus, in a well design where a concern exists to prevent or minimize radial cracks in the cement sheath that occur during pressure testing, including an applied pressure on the production casing as a part of the well design can result in more remaining capacity of the cement sheath over that of a cement sheath associated with a casing that does not have an applied pressure.

As yet another example of considering an applied pressure on the interior of production casing as a factor in a well design and well construction, at each depth evaluated and reported in Tables 1B-1H, the remaining capacity of the cement sheath to withstand shear deterioration during injection is greater in those cement sheaths where pressure is applied to the production casing. Thus, in a well design where a concern exists to prevent or minimize shear deterioration in the cement sheath during injection, an applied pressure on the casing can increase the remaining capacity of the cement sheath over that of a cement sheath associated with a casing that does not have an applied pressure.

Further still, Tables 1B-1H illustrate that in addition to showing greater remaining capacity to withstand shear deterioration during injection and radial cracking during pressure testing, cement sheaths of wells with pressure applied at the production casing showed greater remaining capacity for withstanding radial cracking during injection along depths between 750 ft and 900 ft, and at or about 1250 ft. In certain wells, such as those where the last casing shoe is positioned at or just above 900 ft., maintaining the integrity of the cement sheath at depths between 750 ft. and 900 ft. would result in a well with well-sealed annulus, which would prevent the undesirable flow of fluids back up the casing-in-casing annulus. In still other wells, such as those wells where a well event is performed at or about 1250 ft., (such as steam injection in Example 1), maintaining the integrity of the cement sheath at or about 1250 ft. is desirable.

EXAMPLE 2

The data regarding production casing, cementing composition and well events described below in Table 2A apply to all wells simulated in this Example 2. The wells simulated in this Example 2 would be simulated with a surface casing and a surface casing set depth as described in Example 1. However, the depths at which analysis of the cement sheaths of the wells in Example 2 was performed were greater than the set depth of the surface casing. Thus, data regarding the hole size of the well rather than the surface casing was provided to the WELLLIFE™ program. The wells of Example 2 were simulated with a range of hole sizes and with a range of applied pressures on the interior of the production casing. The hole size of the well, the amount of applied pressure, the depth at which the analysis of the cement sheath was performed, and the results of the analyses of the cement sheaths are reported in Tables 2B-2J.

TABLE 2A

| Production Casing | | Cementing Composition | |
|---|---|---|---|
| outer diameter (inches) | 7 | Young's Modulus (psi) | $0.7 \times 10^6$ |
| inner diameter (inches) | 6.248 | Tensile Strength (psi) | 350 |
| weight (lbs/ft.) | 26 | Poisson's Ratio | 0.23 |
| set depth (ft) | 1600 | Density (lb/gal) | 12 |
| | | Other | non-shrinking foamed cement |
| **Hole Size (inches)** | **Total Well Depth (ft.)** | **Formation** | |
| varied, as indicated in Tables 2B-2J | 1600 | Poisson's Ratio | 0.25 |
| | | Young's modulus (psi) | 35,000 |

TABLE 2A-continued

| Well Events | |
|---|---|
| curing of cement | simulated with a pressure gradient equal to the hydrostatic pressure exerted by a 9.3 lb/gal fluid inside the production casing, the pressure gradient of the cement composition (12 lb/gal) outside the productions casing and the surface casing, and a temperature gradient as illustrated in FIG. 2 |
| pressure testing | simulated to occur after cement set, with an applied surface pressure of 2000 psi, plus the pressure gradient of the 9.3 lb/gal fluid inside the production casing |
| well completion | simulated to occur over 14 days, with a pressure gradient equal to the hydrostatic pressure exerted by the 9.3 lb/gal fluid inside the production casing, a temperature gradient inside the wellbore from 85 to 150° F., and formation temperatures close to the static temperature gradient illustrated in FIG. 2 |
| steam injection | simulated to occur at 580° F. and 1300 psi injection pressure; simulated that injection would expose the cement sheath holding the 7 inch production casing in place to +/−500° F. |

The applied pressure on the production casing was simulated as described above in Example 1. Namely, the gradient of a 9.3 lb/gal fluid was multiplied by the depth to be evaluated, and then added to the amount of pressure to be applied. The sum was then divided by the depth to be evaluated, and the resulting applied pressure factor was input into the WELLLIFE™ program to simulate pressure applied on the interior of the production casing while the cement composition cured.

The remaining capacity of the cement sheaths simulated in an open hole of 8.75" and 9.95", at 1000 ft., and with an applied pressure of 4400-5870 psi is reported in Tables 2B-2D.

TABLE 2B

| Test Depth: 1000 ft. Applied Pressure of 4400 psi on Production Casing during Cement Curing Remaining Capacity (%) for Type of Stress and Hole Size | | | | | | | | |
|---|---|---|---|---|---|---|---|---|
| | Type of Stress | | | | | | | |
| | De-bonding at Formation | | De-bonding at Casing | | Shear deterioration in Cement | | Radial Cracks in Cement | |
| | Hole Size (inches) | | | | | | | |
| Well Event | 8.75" | 9.95" | 8.75" | 9.95" | 8.75" | 9.95" | 8.75" | 9.95" |
| Curing | 100 | 100 | 100 | 100 | 100 | 100 | 100 | 100 |
| Pressure test | 95 | 96 | 89 | 84 | 76 | 75 | 90 | 87 |
| Completion | 91 | 94 | 80 | 72 | 58 | 55 | 84 | 78 |
| Injection | 93 | 95 | 83 | 78 | 35 | 29 | 0 | 0 |

TABLE 2C

| Test Depth: 1000 ft. Applied Pressure of 4890 (psi) on Production Casing during Cement Curing Remaining Capacity (%) for Type of Stress and Hole Size | | | | | | | | |
|---|---|---|---|---|---|---|---|---|
| | Type of Stress | | | | | | | |
| | De-bonding at Formation | | De-bonding at Casing | | Shear Deterioration in Cement | | Radial Cracks in Cement | |
| | Hole Size (inches) | | | | | | | |
| Well Event | 8.921" | 10.05" | 8.921" | 10.05" | 8.921" | 10.05" | 8.921" | 10.05" |
| Curing | 100 | 100 | 100 | 100 | 100 | 100 | 100 | 100 |
| Pressure test | 95 | 95 | 85 | 81 | 70 | 70 | 88 | 84 |
| Completion | 90 | 93 | 75 | 68 | 52 | 51 | 80 | 73 |
| Injection | 93 | 94 | 80 | 73 | 36 | 35 | 0 | 8 |

TABLE 2D

| Test Depth: 1000 ft. Applied Pressure of 5870 (psi) on Production Casing during Cement Curing Remaining Capacity (%) for Type of Stress and Hole Size | | | | | | | | |
|---|---|---|---|---|---|---|---|---|
| | Type of Stress | | | | | | | |
| | De-bonding at Formation | | De-bonding at Casing | | Shear deterioration in Cement | | Radial Cracks in Cement | |
| | Hole Size (inches) | | | | | | | |
| Well Event | 8.921" | 10.05" | 8.921" | 10.05" | 8.921" | 10.05" | 8.921" | 10.05" |
| Curing | 100 | 100 | 100 | 100 | 100 | 100 | 100 | 100 |
| Pressure test | 93 | 94 | 80 | 74 | 60 | 60 | 84 | 77 |
| Completion | 90 | 92 | 70 | 62 | 44 | 40 | 76 | 68 |
| Injection | 91 | 93 | 75 | 67 | 45 | 43 | 14 | 17 |

Tables 2B-2D illustrate that, at 1000 ft., cement sheaths in wells of varied hole sizes and with pressure applied to the interior of the production casing retain capacity to withstand stress without complete failure. Tables 2B-2D further illustrate that as the applied pressure increased, the remaining capacity under shear and radial stress loading during injection increased. Thus, in a well design where preventing or minimizing radial cracking and/or shear deterioration in a cement sheath at about 1000 ft. is a concern, applying a pressure to the production casing of the well during curing can be beneficial.

Tables 2E-2G report remaining capacity of cement sheaths in an open hole of 8.75" and 9.95", at 1250 ft., and with an applied pressure of 3670-5500 psi.

TABLE 2E

| Test Depth: 1250 ft. Pressure of 3670 (psi) Held on Production Casing during Cement Curing Remaining Capacity (%) for Type of Stress and Hole Size | | | | | | | | |
|---|---|---|---|---|---|---|---|---|
| | Type of Stress | | | | | | | |
| | De-bonding at Formation | | De-bonding at Casing | | Shear deterioration in Cement | | Radial Cracks in Cement | |
| | Hole Size (inches) | | | | | | | |
| Well Event | 8.75" | 9.95" | 8.75" | 9.95" | 8.75" | 9.95" | 8.75" | 9.95" |
| Curing | 100 | 100 | 100 | 100 | 100 | 100 | 100 | 100 |
| Pressure test | 96 | 98 | 93 | 90 | 84 | 84 | 95 | 92 |
| Completion | 95 | 95 | 85 | 80 | 65 | 64 | 88 | 83 |
| Injection | 96 | 95 | 88 | 84 | 37 | 35 | 12 | 17 |

TABLE 2F

| Test Depth: 1250 ft. Pressure of 4400 (psi) Held on Production Casing during Cement Curing Remaining Capacity (%) for Type of Stress and Hole Size | | | | | | | | |
|---|---|---|---|---|---|---|---|---|
| | Type of Stress | | | | | | | |
| | De-bonding at Formation | | De-bonding at Casing | | Shear deterioration in Cement | | Radial Cracks in Cement | |
| | Hole Size (inches) | | | | | | | |
| Well Event | 8.75" | 9.95" | 8.75" | 9.95" | 8.75" | 9.95" | 8.75" | 9.95" |
| Curing | 100 | 100 | 100 | 100 | 100 | 100 | 100 | 100 |
| Pressure test | 95 | 97 | 90 | 87 | 75 | 76 | 92 | 89 |
| Completion | 92 | 95 | 84 | 76 | 60 | 56 | 85 | 80 |
| Injection | 93 | 96 | 85 | 80 | 43 | 40 | 20 | 25 |

TABLE 2G

| Test Depth: 1250 ft. Pressure of 5500 (psi) Held on Production Casing during Cement Curing Remaining Capacity (%) for Type of Stress and Hole Size | | | | | | | | |
|---|---|---|---|---|---|---|---|---|
| | Type of Stress | | | | | | | |
| | De-bonding at Formation | | De-bonding at Casing | | Shear deterioration in Cement | | Radial Cracks in Cement | |
| | Hole Size (inches) | | | | | | | |
| Well Event | 8.75" | 9.95" | 8.75" | 9.95" | 8.75" | 9.95" | 8.75" | 9.95" |
| Curing | 100 | 100 | 100 | 100 | 100 | 100 | 100 | 100 |
| Pressure test | 95 | 95 | 85 | 80 | 65 | 65 | 88 | 83 |
| Completion | 92 | 92 | 78 | 70 | 48 | 46 | 80 | 75 |
| Injection | 93 | 93 | 81 | 73 | 50 | 49 | 35 | 38 |

Tables 2E-2G illustrate that the cement sheaths in wells of varied hole sizes, and with an applied pressure on the interior of the production casing, have some remaining capacity at 1250 ft. to withstand the stress of a range of well events. Tables 2E-2G also illustrate that the remaining capacity of the cement sheath for withstanding cracking during injection is greater at 1250 ft. than at 1000 ft. (see Tables 2B-2D). Depending on the well design, preserving the integrity of the cement sheath at 1250 ft. may be a primary concern. For example, the integrity of the cement sheath at 1250 ft. would be an important factor for wells that undergo a well event at or about 1250 ft, and for wells that have a production zone at or about 1250 ft.

Tables 2E-2G also illustrate that at 1250 ft., the greater the applied pressure, the more remaining capacity the cement sheath has for withstanding radial cracking during injection. At applied pressures greater than 3670 psi (4400 and 5500 psi are reported in Tables 2F and 2G), the remaining capacity of the cement sheath at 1250 ft. to withstand shear deterioration during injection also increases. With a greater remaining capacity to withstand stresses such as radial cracking and shear deterioration, the integrity of the cement sheath is less likely to be compromised during a well event such as injection.

Depending on the well design, preserving the integrity of the cement sheath at depths greater than about 1250 ft. may be a concern. Thus, wells with varied hole sizes and applied pressures were simulated to examine the remaining capacity of the cement sheath at 1500 ft. The results are reported in Tables 2H-2J.

TABLE 2H

| | Test Depth: 1500 ft. Applied Pressure of 4400 (psi) on Production Casing during Cement Curing Remaining Capacity (%) for Type of Stress and Hole Size Type of Stress | | | | | | | |
|---|---|---|---|---|---|---|---|---|
| | De-bonding at Formation | | De-bonding at Casing | | Shear deterioration in Cement | | Radial Cracks in Cement | |
| | Hole Size (inches) | | | | | | | |
| Well Event | 8.75" | 9.95" | 8.75" | 9.95" | 8.75" | 9.95" | 8.75" | 9.95" |
| Curing | 100 | 100 | 100 | 100 | 100 | 100 | 100 | 100 |
| Pressure test | 95 | 95 | 90 | 88 | 77 | 75 | 91 | 90 |
| Completion | 91 | 94 | 85 | 80 | 60 | 57 | 85 | 82 |
| Injection | 92 | 94 | 87 | 82 | 15 | 11 | 0 | 4 |

TABLE 2I

| | Test Depth: 1500 ft. Applied Pressure of 5280 (psi) on Production Casing during Cement Curing Remaining Capacity (%) for Type of Stress and Hole Size Type of Stress | | | | | | | |
|---|---|---|---|---|---|---|---|---|
| | De-bonding at Formation | | De-bonding at Casing | | Shear deterioration in Cement | | Radial Cracks in Cement | |
| | Hole Size (inches) | | | | | | | |
| Well Event | 8.75" | 9.95" | 8.75" | 9.95" | 8.75" | 9.95" | 8.75" | 9.95" |
| Curing | 100 | 100 | 100 | 100 | 100 | 100 | 100 | 100 |
| Pressure test | 94 | 95 | 87 | 84 | 70 | 68 | 90 | 85 |
| Completion | 90 | 92 | 80 | 78 | 50 | 50 | 93 | 68 |
| Injection | 91 | 93 | 82 | 77 | 22 | 20 | 5 | 11 |

TABLE 2J

| | Test Depth: 1500 ft. Applied Pressure of 6600 (psi) on Production Casing Remaining Capacity (%) for Type of Stress and Hole Size Type of Stress | | | | | | | |
|---|---|---|---|---|---|---|---|---|
| | De-bonding at Formation | | De-bonding at Casing | | Shear deterioration in Cement | | Radial Cracks in Cement | |
| | Hole Size (inches) | | | | | | | |
| Well Event | 8.75" | 9.95" | 8.75" | 9.95" | 8.75" | 9.95" | 8.75" | 9.95" |
| Curing | 100 | 100 | 100 | 100 | 100 | 100 | 100 | 100 |
| Pressure test | 90 | 93 | 83 | 78 | 58 | 55 | 85 | 80 |
| Completion | 88 | 90 | 75 | 69 | 40 | 37 | 80 | 72 |
| Injection | 89 | 91 | 78 | 71 | 35 | 33 | 20 | 33 |

Tables 2H-2J illustrate that, at 1500 ft., cement sheaths in wells having the properties simulated herein, and with pressure applied to the interior of the production casing during curing, retain some remaining capacity to withstand stress. In the examples reported in Tables 2H-2J, the applied pressures were in the range of about 4400 psi to about 6600 psi. As the applied pressure increased, the remaining capacity under shear and radial stress loading during injection increased. Thus, in a well design where preventing or minimizing radial cracking and/or shear deterioration in a cement sheath at 1500 ft. is a concern, applying a pressure to the production casing of the well can be beneficial.

In all wells, a balance of many factors is struck. For example, in certain wells, it will be a primary concern to prevent radial cracking of the cement sheath near target depths, such as the depths at which production and/or a well event such as steam injection occur, and a lesser concern to prevent debonding at the casing at depths shallower than the target depths. Thus, varied pressures and hole sizes as illustrated herein can be combined to optimize the performance of the cement sheath at a target depth.

Examples 1-2 above demonstrate the efficacy of applying pressure to the casing of a well during curing to enhance the performance of the cement sheath under stress. The following Example 3 demonstrate methods of reducing the weight of production casing and the length of surface casing needed to build a well. The methods illustrated by Example 3 include the methods of designing and building wells with an applied pressure as is illustrated in Examples 1-2. Wells built according to the methods illustrated by Example 3 can be built at a lower cost than wells that do not have an applied pressure on casing in the well.

In the absence of an applied pressure as described herein, the length of surface casing and weight of production casing necessary to construct a well is dictated by factors known to those of ordinary skill in the art, including but not limited to the properties of the formation in which the well is built. In certain wells illustrated in Example 3 where pressure is applied on the interior of the production casing, surface casing is set at depths less than 900 ft., and a production casing having a weight lighter than 26 lb/ft. is used. If the actual wells would have been constructed with surface casing set at or greater than 900 ft., and/or production casing having a weight equal to or greater than 26 lb/ft., then the methods herein provide a reduction in the length of surface casing and the weight of production casing. For example, 26 lb/ft. production casing is often used in the construction of wells, and production casing in weights up to at least 38 lbs/ft. are presently available. According to the methods of reducing production casing weight described in Example 3, a 17 lb/ft. production casing was used. The present methods could also be applied to reduce the production casing weight to less than 17 lb/ft. Thus, the present methods provide for a reduction in casing weight in amounts of from about 20% to about 70% by weight, and in certain examples, from about 35% to about 55% by weight.

One way to consider the reduction in the weight of production casing could be in terms of the weight of surface casing run in the well. As was the case with the wells simulated for Examples 1 and 2, inputting surface casing weight to the program was not necessary to run the simulations in this Example 3. However, the surface casing simulated in each casing combination of this Example 3 would have an actual weight of 36 lb/ft. Thus, in the wells of Example 3, the weight of the production casing is less than about 50% of the weight of the surface casing. In other examples, the production casing could be less than about 80% or less than about 60% or less than about 30% of the weight of the surface casing. Such wells also have cement sheaths with greater remaining capacity after stress events during the life of the well, and have the additional benefit of requiring less materials to construct (i.e., a lighter weight production casing) and are therefore also less costly to build.

The reduction in the length of surface casing could be considered in terms of the total well depth. Thus, the wells of Example 3 demonstrate that with an applied pressure on the interior of the production casing during curing, the surface casing of the well can be set at a depth that is between 5 and 10% of the total depth of the well. In other examples, the surface casing could be set at a depth less than about 15% or less than about 30% of the total depth of the well. Expressed another way, the wells of Example 3 illustrate that with an applied pressure on production casing during curing, surface casing can be set at depths shallower than they could be if no pressure is applied on the production casing. Such a well has enhanced performance of the cement sheath during well events as illustrated above in Examples 1-2, and has the additional benefits of requiring less materials to construct (i.e., less length of surface casing) and is therefore a less costly well to build.

EXAMPLE 3

The well events and cementing composition described below in Table 3A apply to the wells simulated for this Example 3. Three different production casing/surface casing combinations were simulated in the wells. As described in Table 3A, those wells simulated with Casing Combination A had a 26 lb/ft. production casing and a surface casing set at 900 ft. Wells simulated with Casing Combination B had a 17 lb/ft. production casing and a surface casing set at 900 ft. Wells with Casing Combination C had a 17 lb/ft. production casing and a surface casing set at 210 ft.

Data reflecting a pressure of 4400 psi applied to the interior of the production casing while the cement cured was provided to determine how the casing combinations, under pressure, would affect the remaining capacity of the cement sheath and the ability of that cement sheath to withstand stress at a given depth. The applied pressure was simulated as described above in Example 1. Namely, the gradient of a 9.3 lb/gal fluid was multiplied by the depth to be evaluated, and then added to the amount of pressure to be applied. The sum was then divided by the depth to be evaluated, and the resulting applied pressure factor was input into the WELLLIFE™ program to simulate the applied pressure.

In those wells simulated with Casing Combination C, and in those wells simulated with Casing Combination A that were to be analyzed at depths greater than 900 ft., the parameters for hole size rather than surface casing were input into the WELLLIFE™ program because the remaining capacity of the cement sheath would be determined at evaluation depths greater than the set depth of the surface casing. In addition, the input into the WELLLIFE™ program for those wells simulated with Casing Combination B that were to be

TABLE 3A

| Production Casing | | Surface Casing | |
|---|---|---|---|
| | Casing Combination A | | |
| outer diameter (inches) | 7 | outer diameter | 9⅝ |
| inner diameter (inches) | 6.248 | inner diameter | 8.921 |
| weight (lbs/ft.) | 26 | weight (lbs/ft.) | not input to the program |
| set depth (feet) | 1600 | set depth (feet) | 900 |
| | Casing Combination B | | |
| outer diameter (inches) | 7 | outer diameter | 9⅝ |
| inner diameter (inches) | 6.538 | inner diameter | 8.921 |
| weight (lbs/ft.) | 17 | weight (lbs/ft.) | not input to the program |
| set depth (feet) | 1600 | set depth (feet) | 900 |
| | Casing Combination C | | |
| outer diameter (inches) | 7 | outer diameter | 9⅝ |
| inner diameter (inches) | 6.538 | inner diameter | 8.921 |
| weight (lbs/ft.) | 17 | weight (lbs/ft.) | not input to the program |
| set depth (feet) | 1600 | set depth (feet) | 210 |
| Hole Size: 8.75 inches | | Total Well Depth: 1600 ft. | |

| Cementing Composition | | Formation | |
|---|---|---|---|
| Young's Modulus (psi) | $0.7 \times 10^6$ | Poisson's Ratio | 0.25 |
| Tensile Strength (psi) | 350 | Young's modulus (psi) | 35,000 |
| Poisson's Ratio | 0.23 | | |
| Density (lb/gal) | 12 | | |
| Other | non-shrinking foamed cement | | |

| Well Events | |
|---|---|
| curing of cement | simulated with a pressure gradient equal to the hydrostatic pressure exerted by a 9.3 lb/gal fluid inside the production casing, the pressure gradient of the cement composition (12 lb/gal) outside the production casing and the surface casing, and a temperature gradient as illustrated in FIG. 2 |
| pressure testing | simulated with an applied surface pressure of 2000 psi, plus the pressure gradient of the 9.3 lb/gal fluid inside the production casing |
| well completion | simulated to occur over 14 days, with a pressure gradient equal to the hydrostatic pressure exerted by the 9.3 lb/gal fluid inside the production casing, a temperature gradient inside the wellbore from 85 to 150° F., and formation temperatures close to the static temperature gradient illustrated in FIG. 2 |
| steam injection | simulated to occur at 580° F. and 1300 psi injection pressure; simulated that injection would expose the cement sheath holding the 7 inch production casing in place to +/−500° F. |

analyzed at depths greater than 900 ft., was the equivalent of the input for those wells simulated with Casing Combination C. Thus, in the following Tables 3F-3H, there is not a separate entry reporting the analysis of Casing Combination B because the evaluation depths were greater than 900 ft.

Tables 3B-3H report the remaining capacity of the cement sheaths of Example 3 to withstand stress at the reported depth.

TABLE 3B

| Test Depth: 250 ft. Pressure of 4400 psi Held on Production Casing during Cement Curing Remaining Capacity (%) for Type of Stress and Production Casing Weight | | | | | | | | | | | | |
|---|---|---|---|---|---|---|---|---|---|---|---|---|
| | Type of Stress | | | | | | | | | | | |
| | De-bonding at Formation | | | De-bonding at Casing | | | Shear deterioration in Cement | | | Radial Cracks in Cement | | |
| | Casing Combination | | | | | | | | | | | |
| Well Event | A | B | C | A | B | C | A | B | C | A | B | C |
| Curing | 100 | 100 | 100 | 100 | 100 | 100 | 100 | 100 | 100 | 100 | 100 | 100 |
| Pressure test | 32 | 0 | 90 | 40 | 12 | 58 | 69 | 51 | 56 | 55 | 33 | 69 |
| Completion | 0 | 0 | 82 | 10 | 0 | 23 | 47 | 18 | 22 | 30 | 14 | 43 |
| Injection | 0 | 0 | 85 | 25 | 0 | 44 | 28 | 37 | 38 | 0 | 0 | 0 |

TABLE 3C

| Test Depth: 500 ft. Pressure of 4400 psi Held on Production Casing during Cement Curing Remaining Capacity (%) for Type of Stress and Production Casing Weight | | | | | | | | | | | | |
|---|---|---|---|---|---|---|---|---|---|---|---|---|
| | Type of Stress | | | | | | | | | | | |
| | De-bonding at Formation | | | De-bonding at Casing | | | Shear deterioration in Cement | | | Radial Cracks in Cement | | |
| | Casing Combination | | | | | | | | | | | |
| Well Event | A | B | C | A | B | C | A | B | C | A | B | C |
| Curing | 100 | 100 | 100 | 100 | 100 | 100 | 100 | 100 | 100 | 100 | 100 | 100 |
| Pressure test | 11 | 0 | 87 | 57 | 48 | 70 | 70 | 55 | 67 | 65 | 57 | 75 |
| Completion | 0 | 0 | 78 | 46 | 28 | 47 | 51 | 22 | 25 | 55 | 42 | 56 |
| Injection | 0 | 0 | 81 | 53 | 39 | 58 | 23 | 35 | 40 | 0 | 2 | 0 |

TABLE 3D

| Test Depth: 750 ft. Pressure of 4400 psi Held on Production Casing during Cement Curing Remaining Capacity (%) for Type of Stress and Production Casing Weight | | | | | | | | | | | | |
|---|---|---|---|---|---|---|---|---|---|---|---|---|
| | Type of Stress | | | | | | | | | | | |
| | De-bonding at Formation | | | De-bonding at Casing | | | Shear deterioration in Cement | | | Radial Cracks in Cement | | |
| | Casing Combination | | | | | | | | | | | |
| Well Event | A | B | C | A | B | C | A | B | C | A | B | C |
| Curing | 100 | N/A | 100 | 100 | N/A | 100 | 100 | N/A | 100 | 100 | N/A | 100 |
| Pressure test | 71 | N/A | 95 | 66 | N/A | 78 | 70 | N/A | 60 | 72 | N/A | 71 |
| Completion | 48 | N/A | 91 | 38 | N/A | 55 | 45 | N/A | 25 | 46 | N/A | 63 |
| Injection | 60 | N/A | 92 | 52 | N/A | 66 | 25 | N/A | 42 | 8 | N/A | 11 |

TABLE 3E

| Test Depth: 900 ft. Pressure of 4400 psi Held on Production Casing during Cement Curing Remaining Capacity (%) for Type of Stress and Production Casing Weight | | | | | | | | | | | | |
|---|---|---|---|---|---|---|---|---|---|---|---|---|
| | Type of Stress | | | | | | | | | | | |
| | De-bonding at Formation | | | De-bonding at Casing Casing Combination | | | Shear deterioration in Cement Casing Combination | | | Radial Cracks in Cement Casing Combination | | |
| Well Event | A | B | C | A | B | C | A | B | C | A | B | C |
| Curing | 100 | 100 | 100 | 100 | 100 | 100 | 100 | 100 | 100 | 100 | 100 | 100 |
| Pressure test | 45 | 11 | 92 | 70 | 52 | 79 | 70 | 53 | 59 | 75 | 59 | 83 |
| Completion | 2 | 0 | 85 | 48 | 38 | 62 | 49 | 23 | 30 | 55 | 47 | 69 |
| Injection | 20 | 0 | 87 | 58 | 45 | 70 | 31 | 35 | 42 | 20 | 48 | 28 |

TABLE 3F

| Test Depth: 1000 ft. Pressure of 4400 psi Held on Production Casing during Cement Curing Remaining Capacity (%) for Type of Stress and Production Casing Weight | | | | | | | | |
|---|---|---|---|---|---|---|---|---|
| | Type of Stress | | | | | | | |
| | De-bonding at Formation | | De-bonding at Casing Casing Combination | | Shear Deterioration Casing Combination | | Radial Cracks Casing Combination | |
| Well Event | A | C | A | C | A | C | A | C |
| Curing | 100 | 100 | 100 | 100 | 100 | 100 | 100 | 100 |
| Pressure test | 95 | 93 | 88 | 82 | 76 | 60 | 90 | 84 |
| Completion | 92 | 88 | 80 | 66 | 57 | 30 | 83 | 70 |
| Injection | 93 | 89 | 83 | 72 | 35 | 43 | 0 | 24 |

TABLE 3G

| Test Depth: 1250 ft. Pressure of 4400 psi Held on Production Casing during Cement Curing Remaining Capacity (%) for Type of Stress and Production Casing Weight | | | | | | | | |
|---|---|---|---|---|---|---|---|---|
| | Type of Stress | | | | | | | |
| | De-bonding at Formation | | De-bonding at Casing Casing Combination | | Shear Deterioration Casing Combination | | Radial Cracks Casing Combination | |
| Well Event | A | C | A | C | A | C | A | C |
| Curing | 100 | 100 | 100 | 100 | 100 | 100 | 100 | 100 |
| Pressure test | 95 | 95 | 90 | 84 | 75 | 60 | 92 | 86 |
| Completion | 93 | 89 | 84 | 70 | 59 | 32 | 85 | 75 |
| Injection | 94 | 91 | 85 | 75 | 43 | 42 | 20 | 48 |

TABLE 3H

| Test Depth: 1500 ft. Pressure of 4400 psi Held on Production Casing during Cement Curing Remaining Capacity (%) for Type of Stress and Production Casing Weight | | | | | | | | |
|---|---|---|---|---|---|---|---|---|
| | Type of Stress | | | | | | | |
| | De-bonding at Formation | | De-bonding at Casing Casing Combination | | Shear Deterioration Casing Combination | | Radial Cracks Casing Combination | |
| Well Event | A | C | A | C | A | C | A | C |
| Curing | 100 | 100 | 100 | 100 | 100 | 100 | 100 | 100 |
| Pressure test | 95 | 92 | 90 | 85 | 78 | 61 | 92 | 86 |
| Completion | 91 | 86 | 84 | 73 | 59 | 32 | 85 | 77 |
| Injection | 92 | 87 | 86 | 77 | 16 | 34 | 0 | 20 |

The results reported in Tables 3B-3H indicate that when designing a well, an applied pressure on the interior of the production casing during curing of the cement composition should be considered as a factor that causes beneficial results on the performance of the cement sheath during particular well events.

In addition, the results reported in Tables 3B-3H illustrate that the remaining capacity of the cement sheath is greater in those wells simulated with a thinner and lighter weight production casing, such as the production casing of Casing Combinations B and C. For example, at 500 and 900 ft. evaluation depths, the cement sheaths of wells simulated with 17 lb/ft. production casing had a greater remaining capacity to prevent shear deterioration during injection than those cement sheaths simulated with 26 lb/ft. production casing. Use of a 17 lb/ft. production casing instead of a 26 lb/ft. production casing represents about a 35% reduction in casing weight. In addition, less material is needed to manufacture 17 lb/ft production casing than to make 26 lb/ft. casing, and therefore 17 lb/ft. casing is generally less expensive than 26 lb/ft. casing. Thus, methods of reducing weight of production casing used to construct a well are provided by including an applied pressure on the production casing as a part of the well design. Moreover, such a well is less costly to build, and has a cement sheath that can better sustain stress.

Considering the reduction in production weight casing illustrated in Example 3 in terms of the surface casing, (which is 36 lb/ft.), the production casing used in Casing Combinations B and C is less than about 50% by weight. In other examples, the production casing could be less than about 80% or less than about 60% or less than about 30% of the weight of the surface casing.

In addition, the results reported in Tables 3B-3H illustrate methods for reducing the length of surface casing in a well by applying pressure on the interior of the production casing. For example, the wells of Example 3 illustrate that the surface casing can be set at surface casing set depths that are between 5 and 10% of the total depth of the well. In other examples, the surface casing could be set at a depth less than about 5%, less than about 15% or less than about 30% of the total depth of the well. The percentage would be dependent upon the total depth of the well, and the minimum set depth that was demonstrated to be feasible by a WELLIFE simulation.

Expressed another way, the wells of Example 3 illustrate that with an applied pressure on production casing during curing, surface casing can be set at depths shallower than they could be if no pressure is applied on the production casing. For example, the surface casing set at 210 ft. is 77% shallower than the surface casing set at 900 ft. in this Example 3. Such wells have cement sheaths capable of withstanding stress during the life of the well, and are also cost-effective to build because less length of surface casing is used.

EXAMPLE 4

The data regarding two types of production casing, Type A and Type B, cementing composition and well events described below in Table 4A apply to all wells simulated in this Example 4. The surface casing set depth in this Example was about 80 ft., and the depths at which analysis of the cement sheaths was performed were greater than 80 ft. of the surface casing. Thus, data regarding the hole size of the well rather than the surface casing was provided to the WELLLIFE™ program. The hole size of the well, the amount of applied pressure, the depth at which the analysis of the cement sheath was performed, and the results of the analyses of the cement sheaths are reported in Tables 4B-4C.

An applied pressure of 4400 psi on the production casing was simulated as described above with respect to Example 1. Namely, the gradient of a 8.4 lb/gal fluid was multiplied by the depth to be evaluated, and then added to the amount of pressure to be applied. The sum was then divided by the depth to be evaluated, and the resulting applied pressure factor was input into the WELLLIFE™ program to simulate pressure applied on the interior of the production casing while the cement composition cured.

The remaining capacity of the cement sheaths is reported in Tables 4B-4C.

TABLE 4B

| | Test Depth: 100 ft. Applied Pressure of 4400 psi on Production Casing during Cement Curing Remaining Capacity (%) for Type of Stress and Type of Casing Type of Stress | | | | | | | |
|---|---|---|---|---|---|---|---|---|
| | De-bonding at Formation | | De-bonding at Casing | | Shear deterioration in Cement | | Radial Cracks in Cement | |
| | Production Casing Type | | | | | | | |
| Well Event | A | B | A | B | A | B | A | B |
| Curing | 100 | 100 | 100 | 100 | 100 | 100 | 100 | 100 |
| Pressure test | 69 | 83 | 9 | 52 | 60 | 52 | 35 | 65 |
| Completion | 85 | 79 | 0 | 38 | 82 | 38 | 69 | 55 |
| Injection | 87 | 80 | 0 | 40 | 55 | 43 | 0 | 0 |

TABLE 4A

| Production Casing Type | A | B | Cementing Composition | |
|---|---|---|---|---|
| outer diameter (inches) | 7 | 7 | Young's Modulus (psi) | $0.57 \times 10^6$ |
| inner diameter (inches) | 6.366 | 5.92 | Tensile Strength (psi) | 220 |
| weight (lbs/ft.) | 23 | 38 | Poisson's Ratio | 0.23 |
| set depth (ft) | 1500 | 1500 | Density (lb/gal) | 11.0 |
| | | | Other | non-shrinking foamed cement |
| **Hole Size (inches)** | **Total Well Depth (ft.)** | | **Formation** | |
| 9.875 | 1600 | | Poisson's Ratio | 0.15 |
| | | | Young's modulus (psi) | 30,000 |
| **Well Events** | | | | |
| curing of cement | simulated with a pressure gradient equal to the hydrostatic pressure exerted by a 8.4 lb/gal fluid inside the production casing, the pressure gradient of the cement composition (11 lb/gal) outside the production casing and the surface casing, and a temperature gradient of 2.0° F./100 ft and surface temperature of 80° | | | |
| pressure testing | simulated with an applied surface pressure of 1000 psi, plus the pressure gradient of the 8.4 lb/gal fluid inside the production casing | | | |
| well completion | simulated to occur over 7 days, with a pressure gradient equal to the hydrostatic pressure exerted by the 8.4 lb/gal fluid inside the production casing, a temperature gradient inside the wellbore from 85 to 110° F., and formation temperatures close to the static temperature gradient illustrated in FIG. 2 | | | |
| steam injection | simulated that injection would expose the cement sheath holding the 7 inch casing to 445° F. and 400 psi injection pressure | | | |

TABLE 4C

| | Test Depth: 250 ft. Applied Pressure of 4400 psi on Production Casing during Cement Curing Remaining Capacity (%) for Type of Stress and Type of Casing Type of Stress | | | | | | | |
|---|---|---|---|---|---|---|---|---|
| | De-bonding at Formation | | De-bonding at Casing | | Shear deterioration in Cement | | Radial Cracks in Cement | |
| | Production Casing Type | | | | | | | |
| Well Event | A | B | A | B | A | B | A | B |
| Curing | 100 | 100 | 100 | 100 | 100 | 100 | 100 | 100 |
| Pressure test | 83 | 91 | 35 | 65 | 62 | 79 | 50 | 74 |
| Completion | 79 | 89 | 18 | 55 | 53 | 75 | 38 | 65 |
| Injection | 80 | 89 | 22 | 57 | 54 | 48 | 0 | 0 |

Tables 4B-4C illustrate that de-bonding that occurs at shallower depths when pressure is applied to the production casing can be minimized by using a heavier production casing, for example, a 38 lb/.ft casing as illustrated in Example 4. In this example, the shallower depths analyzed were less than or equal to 250 ft. in a well having a 1500 ft. total depth, or about 16% of the total well depth. In combination with Examples 1-3, Example 4 illustrates that in a well with an applied pressure on the interior of the production casing, one type of production casing can be run to a shallow depth, for example less than about 20% of the total well depth, and another type of production casing can be run from the shallow depth to the total well depth. Cement sheaths in wells having the properties simulated herein, and with pressure applied to the interior of the production casing during curing, would retain some remaining capacity to withstand stress as illustrated in Examples 1-3, and debonding would also be prevented or minimized.

While the examples described herein relate to methods for performing cementing operations in a wellbore, designing a well, constructing a well, and the durability of wells constructed according to such methods, the foregoing specification is considered merely exemplary of the current invention with the true scope and spirit of the invention being indicated by the following claims.

What is claimed is:

1. A method of cementing in a wellbore comprising:

introducing a cement composition into a casing placed in the welibore;

displacing the cement composition from the casing into an annulus formed in part by the casing; and applying continuously constant pressure in range of from about 2,300 psi to about 20,000 psi to the interior of the casing to pre-stress the casing while the cement composition cures in the annulus;

wherein a cement sheath formed from the cement composition has an improved ability to withstand stress-causing well events.

2. The method of claim 1 further comprising:

applying pressure to the casing upon introduction of the cement composition into the casing at least until the cement composition has developed a measurable compressive strength.

3. The method of claim 1 further comprising:

applying pressure to the casing upon introduction of the cement composition into the casing at least until the cement composition has set.

4. The method of claim I further comprising:

introducing a displacement fluid into the casing after introducing the cement composition, which displacement fluid displaces the cement composition into the annulus; and continuing the introduction of the displacement fluid into the casing after displacement of the cement composition into the annulus, which continuation of introduction of the displacement fluid applies pressure to the interior of the casing while the cement composition cures in the annulus.

5. The method of claim 1 further comprising:

introducing a displacement fluid into the casing after introducing the cement composition, which displacement fluid displaces the cement composition into the annulus;

introducing a gas into the casing after displacement of the cement composition into the annulus; and continuing the introduction of at least one of the gas and the displacement fluid to apply the pressure to the interior of the casing while the cement composition cures in the annulus.

6. The method of claim 1 further comprising:

introducing a gas into the casing;

introducing a displacement fluid into the casing to displace the cement composition into the annulus at least in part; and continuing introduction of at least one of the gas and the displacement fluid.

7. The method of claim 1 wherein the application of pressure further comprises applying the pressure in a range of from about 2300 psi to about 8000 psi.

8. The method of claim 1 wherein the application of pressure further comprises applying the pressure in a range of from about 2300 psi to about 7000 psi.

9. A method of constructing a well comprising:

drilling a wellbore in a formation;

running a surface casing in the wellbore to a surface casing set depth;

cementing the surface casing in the wellbore;

running a production casing through the surface casing and into the wellbore to a production casing set depth that is greater than the surface casing set depth;

introducing a cement composition into the production casing;

displacing the cement composition from the production casing into an annulus formed in part by the production casing; and applying continuously constant pressure in a range from about 2,300 psi to about 20,000 psi to the interior of the production casing to pre-stress the production casing while the cement composition cures in the annulus;

wherein a cement sheath formed from the cement composition has an improved ability to withstand stress-causing well events.

10. The method of claim 9 wherein the formation has a Poisson's ratio of from about 0.20 to about 0.30.

11. The method of claim 9 wherein the formation has Young's modulus of from about 20,000 to about 50,000 psi.

12. The method of claim 9 wherein the drilling of the welibore in the formation further comprises drilling the wellbore to a total depth, and the surface casing set depth is less than about 30% of the total depth.

13. The method of claim 12 wherein the surface casing set depth is less than about 15% of the total depth.

14. The method of claim 12 wherein the surface casing set depth is between about 5 and about 10% of the total depth.

15. The method of claim 12 wherein the running of the production casing further comprises running a production casing having a weight that is less than about 50% of the weight of the surface casing.

16. The method of claim 12 wherein the running of the production casing further comprises running a production casing having a weight that is less than about 80% of the weight of the surface casing.

17. The method of claim 9 wherein the running of the production casing further comprises running a production casing having a weight that is less than about 50% of the weight of the surface casing.

18. The method of claim 9 wherein the running of the production casing further comprises running a production casing having a weight that is less than about 80% of the weight of the surface casing.

19. The method of claim 9 wherein the application of pressure to the interior of the production casing further comprises applying pressure in a range of from about 2300 psi to about 8000 psi.

20. The method of claim 9 wherein the applying of pressure further comprises applying the pressure in a range of from about 2300 psi to about 7000 psi.

21. The method of claim 9 further comprising:

introducing a displacement fluid into the production casing after introducing the cement composition to cause the displacement of the cement composition; and continuing the introduction of the displacement fluid into the production casing after displacement of the cement composition into the annulus to cause the application of pressure to the interior of the production casing while the cement composition cures in the annulus.

22. The method of claim 9 further comprising:

introducing a gas into the production casing after displacement of the cement composition into the annulus to cause the application of pressure to the interior of the production casing while the cement composition cures in the annulus.

23. The method of claim 22 further comprising:

introducing a displacement fluid into the production casing.

24. The method of claim 9 wherein the running of the production casing to a production casing set depth comprises:

running a first production casing to a first production casing set depth; and running a second production casing from the first production casing set depth to the production casing set depth, which second production casing is lighter than the first production casing.

25. A well comprising:

a wellbore; and a pre-stressed production casing, which is pre-stressed by application of continuously constant pressure in a range of from about 3,670 psi to about 20,000 psi to the interior of the production casing during curing of a cement composition introduced into the wellbore to hold the production casing in place;

wherein the cement sheath formed from the cement composition has improved ability to withstand stress-causing well events.

26. The well of claim 25 further comprising:

a surface casing set in the wellbore at a surface casing set depth, wherein the pre-stressed production casing runs through the surface casing and into the wellbore, and is set at a production casing set depth that is greater than the surface casing set depth.

27. The well of claim 26 wherein the wellbore has a total depth, and the surface casing set depth is less than about 30% of the total depth.

28. The well of claim 26 wherein the welibore has a total depth, and the surface casing set depth is less than about 15% of the total depth.

29. The well of claim 26 wherein the wellbore has a total depth, and the surface casing set depth is between about 5 and about 10% of the total depth.

30. The well of claim 26 wherein the production casing has a weight that is less than about 50% of the weight of the surface casing.

31. The well of claim 26 wherein the production casing has a weight that is less than about 80% of the weight of the surface casing.

32. The well of claim 25 wherein the applied pressure is in a range of from about 3,670 psi to about 8000 psi.

33. The well of claim 25 wherein the well has an inner diameter of from about 1 inch to about 14 inches.

34. The well of claim 25 wherein the well has an inner diameter of from about 7 inches to about 11 inches.

35. The well of claim 25 further comprising:

a cement sheath associated with the production casing, which cement sheath has ability to withstand stress at a target depth.

36. The well of claim 25 wherein the pre-stressed production casing comprises a first production and a second production casing, which second production casing is lighter than the first production casing.

37. A method for reducing production casing weight used in constructing a well comprising:

applying continuously constant pressure in a range of from 2,300 psi to about 20,000 psi to the interior of the production casing, in an amount effective to pre-stress the production casing, while a cement composition cures in an annulus formed in part by the production casing, wherein the production casing is thinner and lighter in weight than a production casing used in a well where pressure has not been applied to the interior of the production casing while cement cures in an annulus formed in part by the production casing.

38. The method of claim 37 wherein the reduction is from about 20% to about 70% by weight.

39. The method of claim 37 wherein the reduction is from about 35% to about 55% by weight.

40. The method of claim 37 wherein the application of pressure to the interior of the production casing further comprises applying pressure in a range of from about 2300 psi to about 8000 psi.

41. The method of claim 37 wherein the applying of pressure further comprises applying the pressure in a range of from about 2300 psi to about 7000 psi.

42. The method of claim 37 further comprising:

introducing the cement composition into the production casing;

displacing the cement composition into the annulus by introducing a displacement fluid into the production casing; and continuing the introduction of the displacement fluid into the production casing after displacement of the cement composition into the annulus to cause the application of pressure to the interior of the production casing while the cement composition cures in the annulus.

43. The method of claim 37 further comprising:

introducing the cement composition into the production casing;

displacing the cement composition into the annulus by introducing a displacement fluid into the production casing; and introducing a gas into the production casing after displacement of the cement composition into the annulus to cause the application of pressure to the interior of the production casing while the cement composition cures in the annulus.

44. A method of constructing a well comprising:

drilling a wellbore in a formation to a total depth, and the surface casing set depth is between about 5 and about 10% of the total depth;

running a surface casing in the wellbore to a surface casing set depth;

cementing the surface casing in the wellbore;

running a production casing through the surface casing and into the wellbore to a production casing set depth that is greater than the surface casing set depth;

introducing a cement composition into the production casing;

displacing the cement composition from the production casing into an annulus formed in part by the production casing; and applying continuously constant pressure in a range from about 2,300 psi to about 20,000 psi to the interior of the production casing to pre-stress the production casing while the cement composition cures in the annulus;

wherein a cement sheath formed from the cement composition has an improved ability to withstand stress-causing well events.

45. A well comprising:

a welibore having a total depth;

a pre-stressed production casing, which is pre-stressed by application of continuously constant pressure in a range of from about 3,670 psi to about 20,000 psi to the interior of the production casing during curing of a cement composition introduced into the wellbore to hold the production casing in place; and a surface casing set in the wellbore having a surface casing set depth that is between about 5 to 10% of the total depth of the wellbore, wherein the pre-stressed production casing runs through the surface casing and into the wellbore, and is set at a production casing set depth that is greater than the surface casing set depth; and the cement sheath formed from the cement composition has improved ability to withstand stress-causing well events.

* * * * *